United States Patent [19]

Berfield

[11] Patent Number: 4,993,457

[45] Date of Patent: Feb. 19, 1991

[54] HOUSING ARRANGEMENT FOR A FLUID PUMP AND TANK

[75] Inventor: Robert C. Berfield, Jersey Shore, Pa.

[73] Assignee: Shop-Vac Corporation, Williamsport, Pa.

[21] Appl. No.: 554,707

[22] Filed: Jul. 18, 1990

[51] Int. Cl.[5] ..... A01G 25/09

[52] U.S. Cl. ..... 137/899; 137/259; 137/315; 137/559; 137/377; 220/5; 220/4.12

[58] Field of Search ..... 137/259, 565, 377, 382, 137/559, 315; 220/5 A, 23.83, 23.86, 3, 855

[56] References Cited

U.S. PATENT DOCUMENTS

| | | | |
|---|---|---|---|
| 2,779,476 | 1/1957 | Barker | 137/529 |
| 3,570,508 | 3/1971 | Boggs et al. | 137/559 |
| 3,789,877 | 2/1974 | Noren et al. | 137/559 |
| 4,628,960 | 12/1986 | Brickell et al. | 137/899.4 |
| 4,660,602 | 4/1987 | Druman | 137/899.4 |
| 4,802,502 | 2/1989 | Williams | 137/377 |
| 4,842,139 | 6/1989 | Krieg | 220/3 |
| 4,936,349 | 6/1990 | Cowgur | 137/899 |

*Primary Examiner*—A. Michael Chambers

*Attorney, Agent, or Firm*—Ostrolenk, Faber, Gerb & Soffen

[57] ABSTRACT

A housing for a high pressure fluid washer, for example, has mounted within it a fluid pump and a first tank. The first tank may be fully installed within the housing simply by pressing the tank upwardly within an entrance port of the housing. Visual observation of the fluid level within the tank is permitted due to a vertically oriented rib of the tank projecting into a recess window of the housing wall, with such rib being suitably translucent to transparent. The tank rib and recess window of the housing may cooperate to orient the tank within the housing. Where a second fluid tank is required, the housing may be placed atop and aligned to the second tank via respective, interfitting couplings mounted to the housing bottom and to the second tank top.

7 Claims, 5 Drawing Sheets

HOUSING ARRANGEMENT FOR A FLUID PUMP AND TANK

BACKGROUND AND SUMMARY OF THE INVENTION

The present invention relates to a housing arrangement for a fluid pump and fluid tank.

Apparatus that ejects fluid at high pressure for washing purposes, for example, may typically include a fluid pump and a fluid tank that are contained within a housing. A desirable feature of such an apparatus would be to provide a simple indication of fluid level within the tank. Another desirable feature would be that of easy installation of the tank within the housing. It would further be desirable when two fluid tanks are required, for two different fluids such as detergent and degreaser, to enable the housing and a second tank to be easily attached together.

Various of the foregoing features are realized in one form of the present inventive housing arrangement for a fluid pump and fluid tank. The arrangement comprises a housing for enclosing the pump and tank, and flow means within the housing for placing the pump and tank in flow communication with each other. To provide a simple indication of fluid level within the tank, the housing has a vertically oriented recess in the vicinity of the tank. The tank has a cooperating, vertically oriented rib extending into the housing recess. A user can view the rib section through the housing recess and thereby observe the fluid level within the tank. In accordance with a further feature of the invention, the rib section of the tank cooperates with the housing recess to orient the tank within the housing.

In accordance with another feature of the invention, the installation of the tank within the housing is readily accomplished by merely pressing the tank upwardly through an entry port into the housing. During such procedure, a downwardly depending conduit mounted within the housing projects into the tank so as to automatically place the tank in flow communication with the pump. The tank may be held in place within the housing through an upwardly facing tab of a housing wall portion that cooperates with a downwardly facing tab engaging portion of the tank.

Where a second fluid tank is also used, the flow means additionally places the pump and the second tank in flow communication with each other. For this purpose, the flow means includes a fluid coupling member mounted to a bottom surface of the housing and oriented downwardly so as to receive a mating fluid coupling member mounted to a top portion of the tank. Thus, by placing the housing atop the second tank and engaging the fluid coupling members, attachment of the housing to the tank is facilitated.

BRIEF DESCRIPTION OF THE DRAWINGS

Other objects, features and advantages of the present invention will be understood from the following detailed description of embodiments thereof, with reference to the drawings, in which.

DESCRIPTION OF THE PREFERRED EMBODIMENTS

Figure 1:
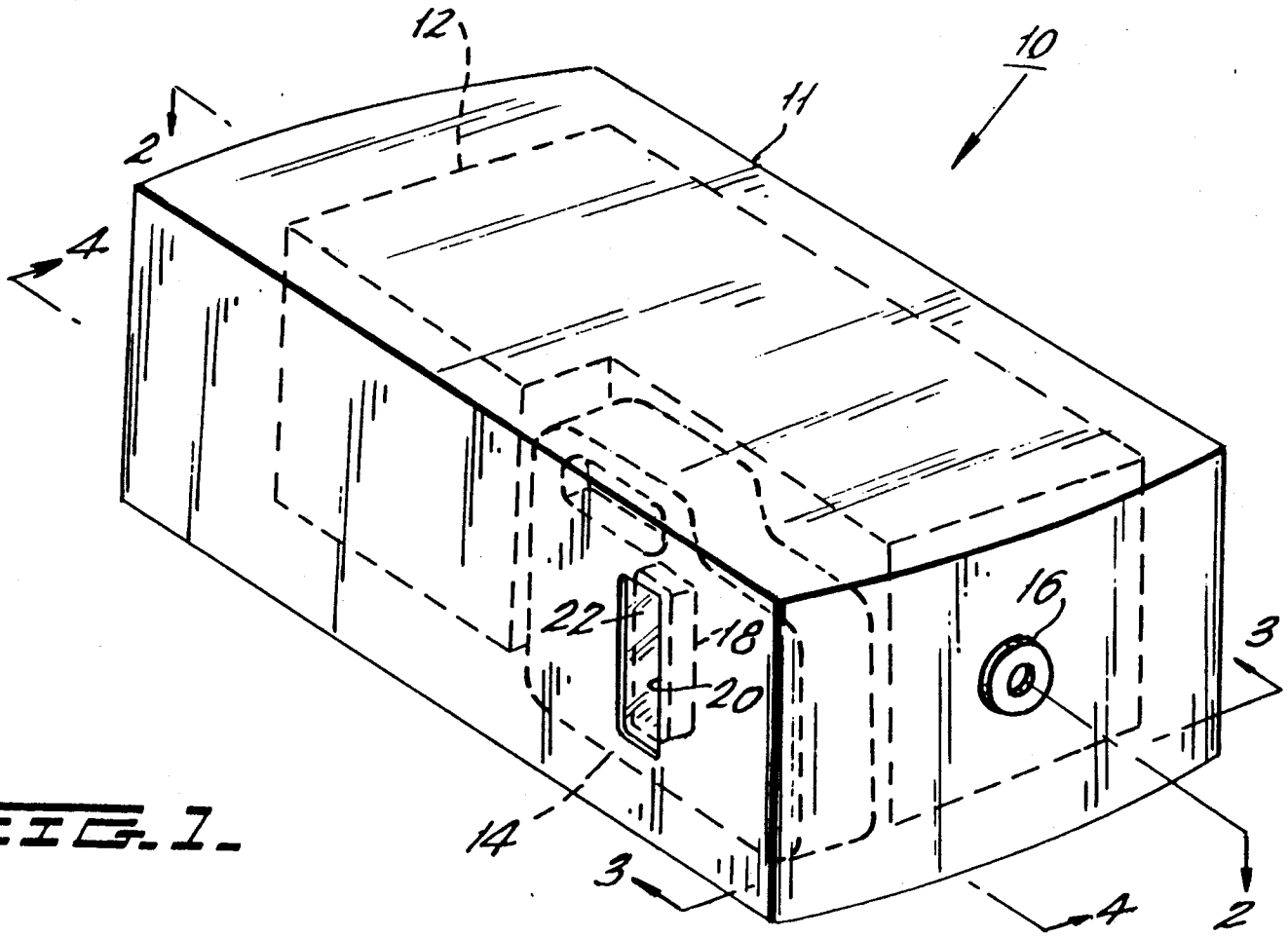
FIG. 1 is a simplified, perspective view of a housing arrangement for a fluid pump and a fluid tank in accordance with the invention.

FIG. 1 shows a simplified, perspective view of a housing arrangement 10 for a fluid pump 12 shown schematically, and a fluid tank 14. The pump 12 is associated with a fluid coupling 16 permitting the pump 12 to be placed in flow communication with an external flow means (not shown) such as a nozzle. The housing arrangement 10 includes a housing 11 which contains a recess and window 20 into which a vertically oriented outwardly projecting rib 18 of the tank 14 projects so that such rib is visible from outside of the housing 10. The rib 18 itself is sufficiently translucent as to allow observation of a fluid level within the tank upon viewing the rib 18 through the window recess 20.

Figure 2:
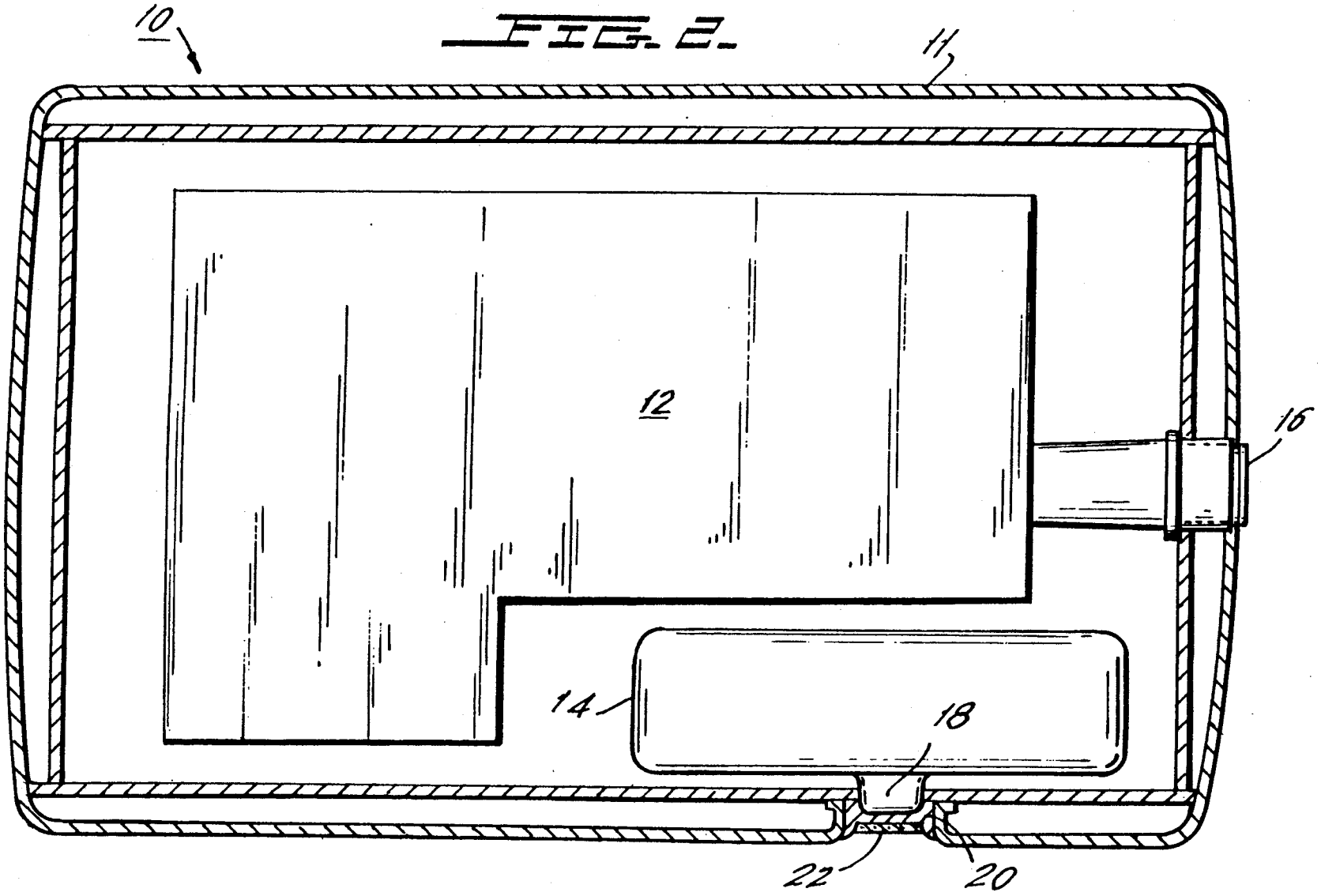
FIG. 2 is a simplified, sectional view of the inventive housing arrangement taken along the line 2—2 in FIG. 1.

Turning to FIG. 2, further details of the rib 18 and the window recess 20 of the housing 11 are shown. Preferably, the rib 18 is dimensioned to cooperate with the window recess 20 so as to place and orient the tank 14 within the housing 11. A transparent window 22 may cover the window recess 20 to preferably provide a watertight seal for the housing in the vicinity of the window recess 20.

The fluid tank 14 may be formed from blowmolded plastic, for example, and preferably is highly translucent, or even transparent, to permit viewing of any fluid contents. But at least the rib 18 is of material to permit viewing.

Figure 3:
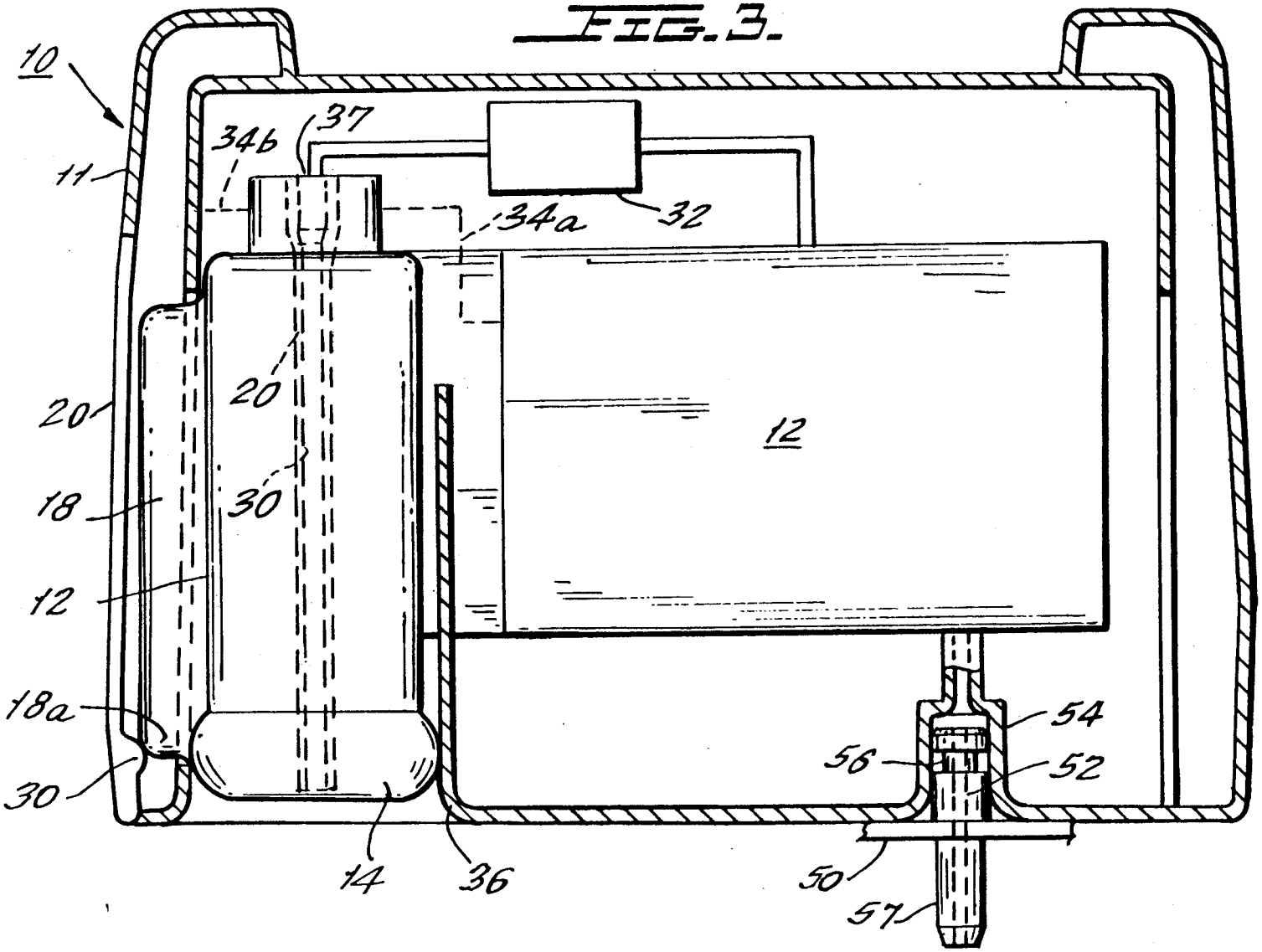
FIG. 3 is a further simplified, sectional view, partially in block form, and with portions removed for the sake of clarity of the inventive housing arrangement of FIG. 1, taken along the line 3—3 in FIG. 1.

Referring now to FIG. 3, the housing arrangement 11 includes a vertically oriented conduit 30 which extends downwardly within the tank 14 through an opening in the tank (not shown). The conduit 30 extends nearly to the bottom of the tank and is in flow communication with the pump 12 via a suitable fluid control means 32 which is in the form of a multiple function valve, for example. A user would typically have access to fluid control means 32 via a suitable, external controller (not shown). The conduit 30 is preferably mounted to the pump 12 as indicated by dashed line **34*a*, although it could also be mounted to the housing 11 as indicated by alternative dashed lines 34*b***.

The fluid tank 14 is installed in the housing 11 by inserting it upwardly through an entry port 36 in the bottom wall of the housing until a tab-engaging section **18*a* of the tank rib 18 passes above a tab 38 of the housing 11. Tab 38 is resiliently biased relative to tab-engaging section 18*a* in a detent arrangement to keep the tank 14 in place in the housing 11. Such resiliency is provided by flexibility of the wall portion of the tank 14 that contains the tab-engaging portion 18*a* as well as, to a lesser extent, by flexibility of the wall portion of the housing 11 that contains tab 38**.

When the fluid tank 14 is inserted into the housing 11 through the entry port 36, the rib 18 of the tank engages within the window recess 20 (see also FIG. 2) of the housing to properly orient the tank within the housing. Meanwhile, the downwardly extending conduit 30 projects through a fitting 37 at the top of the tank, whereby tank installation is complete once tab 38 of the housing engages tab engaging section 18*a* of the tank, as shown.

Figure 4:
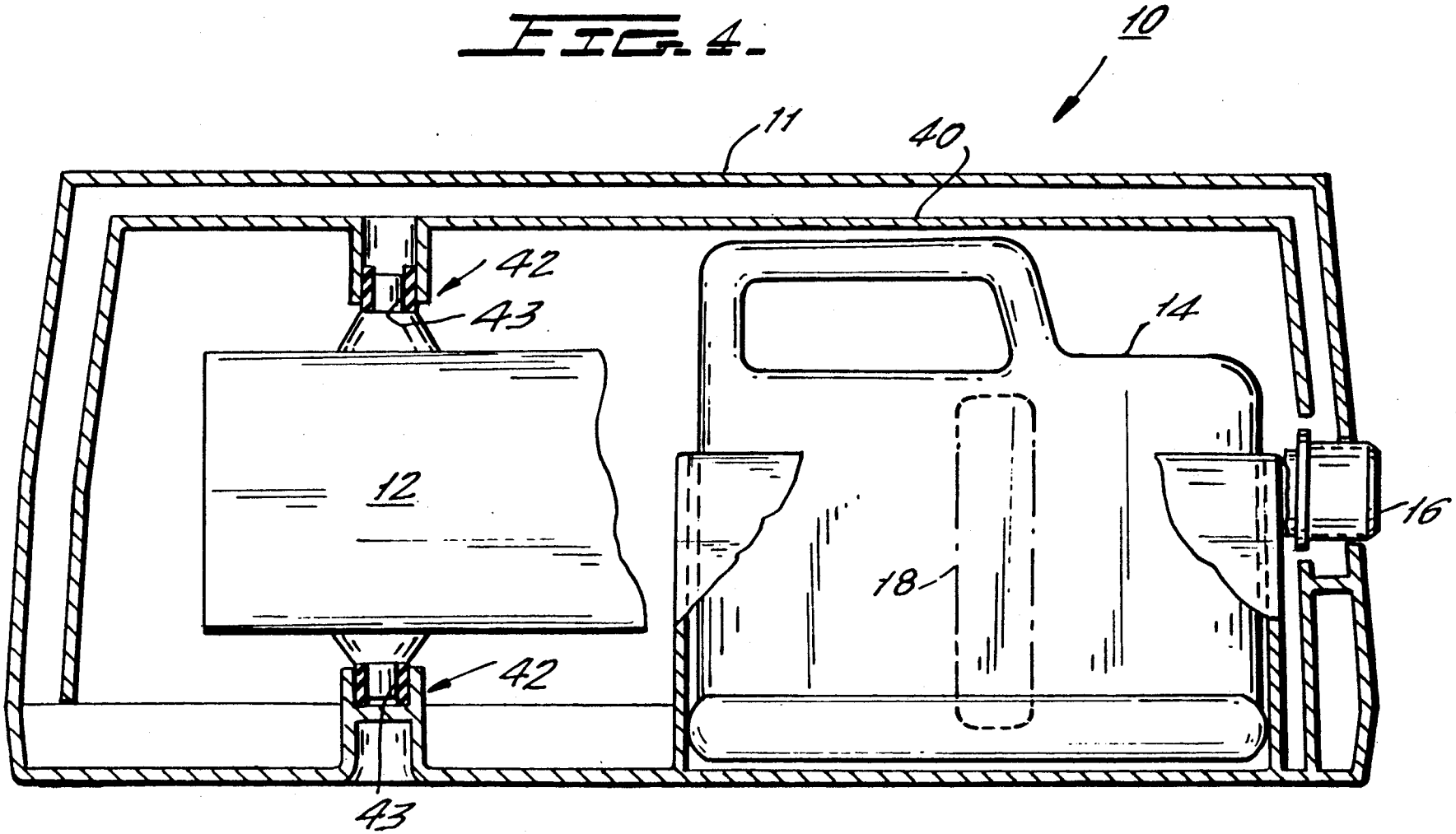
FIG. 4 is another simplified, sectional view of the inventive housing arrangement, with portions partially broken away for the sake of clarity, taken along the line 4—4 in FIG. 1.

Turning to FIG. 4, to facilitate transport of the tank 14, the tank includes a handle 40 at its top. The pump 12 is mounted to the housing 11 by shock absorbing mountings 42 which comprise respective rubber pieces 43 between the pump 12 and the housing 11. Further details of the pump 12 are disclosed in copending and commonly assigned U.S. applications Ser. No. 297,620, filed on Jan. 17, 1989 and Ser. No. 462,733, filed on Jan. 9, 1990, the entirety of whose disclosures are incorporated herein by reference.

Figure 5:
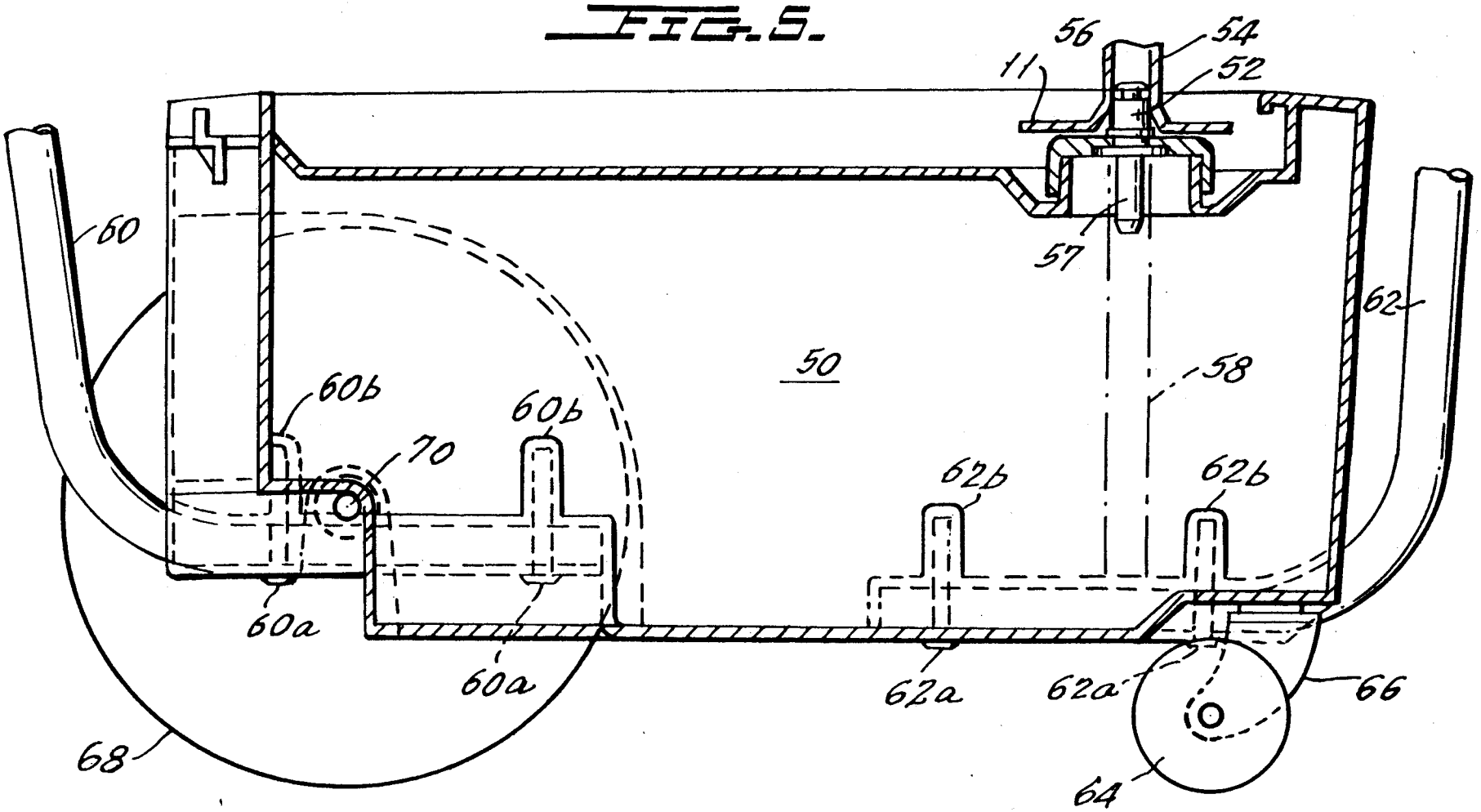
FIG. 5 is a side plan view of a second fluid tank on which the housing arrangement of FIG. 1 may be conveniently positioned in accordance with another embodiment of the invention.

FIGS. 3 and 5 show an embodiment of the invention used when it is desired to selectively pump a second fluid in addition to the fluid contained in the tank 14. For example, it may be desired to selectively pump either a detergent liquid or a degreaser liquid or even both of them. As shown in FIG. 5, a tank 50 is provided for the second liquid. The bottom of the housing 11 is positioned on and removably attached to the top of the tank 50, as seen in FIGS. 3 and 5. For this purpose, the tank 50 includes an upwardly projecting fluid coupling member 52 for insertion within a mating fluid coupling member 54 which is formed integrally in the bottom of the housing 11. An O-ring 56 contained within an exterior groove on the coupling part 52 provides a seal between the coupling members 52 and 54. A lower portion 57 of the coupling member 52 extends into the interior of fluid tank 50 and is preferably brought into flow communication with the lower portion of the tank 50 via a further conduit 58, shown in dashed lines.

Advantageously, the placement of the housing 11 onto the tank 50 is facilitated by the cooperating coupling parts 52 and 54 which serve to align the housing and tank relative to each other.

In order to facilitate movement between locations, the tank 50 includes handles 60 and 62 and rolling support wheels 64 and 68. The handles 60 and 62 are respectively coupled to the tank 50 via bolts 60*a* and 62*a* that are threadedly received respectively within mating portions 60*b* and 62*b* of the tank 50. The wheel 64 is mounted on a caster assembly 66 attached to one end of the tank 50. The wheels 68 are secured to the tank 50 via axle portions 70, which may be held in place with the cooperation of the handle 60 as shown.

The fluid control means 32 in this embodiment, under the control of a suitable, external controller (not shown), functions to connect the pump 12 to either the tank 14 or the tank 50.

The foregoing describes a housing arrangement for fluid pump and a fluid tank providing a simple indication of fluid level within the tank, permitting easy installation of the tank within the housing, and enabling a convenient interconnection of such housing arrangement atop a further fluid tank when it is desired to selectively pump two liquids.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A housing arrangement for a fluid pump and tank, comprising:

a housing; a fluid pump mounted within the housing;

a tank for containing a fluid; the tank having a vertically oriented rib;

the housing having an entry port through which the tank for fluid may be inserted within the housing; the housing having a vertically oriented recess for receiving the tank rib when the tank is inserted into the housing;

flow means within the housing for placing the pump and the tank in flow communication with each other; and the recess being positioned in the housing such that when the tank rib is received the recess the tank is aligned with the flow means.

2. The housing arrangement of claim 1, wherein:

the housing recess includes a window to allow viewing of the tank rib from outside of the housing; and the tank rib is of material which allows observation of the fluid level within the tank.

3. The housing arrangement of claim 1, wherein:

the housing has a bottom surface and the entry port is located in the bottom surface such that the tank may be inserted into the housing in an upward direction; and the flow means includes a downwardly extending conduit which is received into the tank when the tank is inserted upwardly through the entry port in the housing.

4. The housing arrangement of claim 3, the tank has a lower portion which includes an engaging portion facing downwardly; and the housing includes a cooperating engaging element projecting upwardly for resiliently engaging the engaging portion of the tank to hold the tank in place within the housing.

5. An arrangement for selectively dispensing two liquids, which comprises:

a housing having a sidewall with a vertically oriented recess formed therein;

a fluid pump mounted within the housing;

a first tank for a first liquid, the first tank having a vertically oriented rib, the first tank being mounted within the housing such that the tank rib is received within the housing recess;

the housing having a bottom surface with an entry port formed therein through which the first tank may be inserted into the housing; a first fluid coupling on the bottom surface of the housing;

a second tank for a second liquid, the second tank having a top surface for supporting the housing thereon; a second fluid coupling member mounted on the top surface of the second tank and matable with the first fluid coupling member for establishing flow communication between the second tank and the first fluid coupling member; and means for selectively connecting the pump to either the first tank or the second tank.

6. Apparatus as in claim 5, wherein the housing recess includes a window to allow viewing of the rib of the first tank from outside of the housing; and the rib of the first tank is of a material which allows observation of the fluid level within the first tank.

7. Apparatus as in claim 6, wherein the second tank includes support and rolling wheels and a handle to facilitate movement of the second tank with the housing thereon.

* * * * *